US007992900B2

(12) United States Patent
Jacobs

(10) Patent No.: US 7,992,900 B2
(45) Date of Patent: Aug. 9, 2011

(54) POLE ANCHOR AND SKI POLE BASE WITH EXTENDING BRUSH BRISTLES AND ACIRCULAR, PREFERABLY HEXAGONAL, SECTION

(75) Inventor: John J. Jacobs, Queensbury, NY (US)

(73) Assignee: Reliable Racing Supply, Inc., Queensbury, NY (US)

( * ) Notice: Subject to any disclaimer, the term of this patent is extended or adjusted under 35 U.S.C. 154(b) by 228 days.

(21) Appl. No.: 12/432,303

(22) Filed: Apr. 29, 2009

(65) Prior Publication Data

US 2009/0273173 A1 Nov. 5, 2009

Related U.S. Application Data

(60) Provisional application No. 61/071,491, filed on May 1, 2008.

(51) Int. Cl.
*A63C 11/22* (2006.01)

(52) U.S. Cl. ..... 280/809; 280/819

(58) Field of Classification Search ..... 280/809, 280/819, 820, 823, 824; 135/77–81; 404/9–11; 411/508–510; *A63C 11/22*
See application file for complete search history.

(56) References Cited

U.S. PATENT DOCUMENTS

| | | | | |
|---|---|---|---|---|
| 3,199,886 | A | 8/1965 | Dover | |
| 3,743,311 | A | 7/1973 | Giambazi | |
| 3,858,900 | A | 1/1975 | Quinn | |
| 3,890,054 | A * | 6/1975 | O'Connor | 404/10 |
| 3,896,823 | A * | 7/1975 | Spatz | 132/218 |
| 4,093,250 | A | 6/1978 | Wikstrand | |
| 4,221,393 | A | 9/1980 | Donahue | |
| 4,422,986 | A * | 12/1983 | Cole | 264/39 |
| 4,718,138 | A | 1/1988 | Brown et al. | |
| 4,871,279 | A * | 10/1989 | Hinterholzer | 404/10 |
| 5,186,507 | A | 2/1993 | Neidfeld | |
| 5,232,322 | A * | 8/1993 | Regensburger | 411/33 |
| 5,387,065 | A * | 2/1995 | Sullivan | 411/48 |
| 5,679,067 | A | 10/1997 | Johnson et al. | |
| 5,907,891 | A * | 6/1999 | Meyer | 24/453 |
| 5,909,991 | A * | 6/1999 | Manion et al. | 411/377 |
| 5,934,729 | A * | 8/1999 | Baack | 296/39.1 |
| 6,015,165 | A | 1/2000 | Artemis et al. | |
| 6,390,109 | B1 | 5/2002 | Manninen | |
| D462,407 | S | 9/2002 | Martin | |
| 6,460,891 | B1 | 10/2002 | Jones | |
| 6,536,718 | B2 * | 3/2003 | Benito-Navazo | 248/71 |
| 6,575,986 | B2 * | 6/2003 | Overaker | 606/151 |
| 6,719,513 | B1 * | 4/2004 | Moutousis et al. | 411/510 |
| 6,804,864 | B2 * | 10/2004 | Kirchen et al. | 24/297 |
| 6,877,520 | B2 | 4/2005 | Morris | |

(Continued)

OTHER PUBLICATIONS

World Cup Supply—Ski Area & Event Supplies Catalog, pp. 3-5, 2008-2009 (5 pages total).

*Primary Examiner* — Paul N. Dickson
*Assistant Examiner* — Barry Gooden, Jr.
(74) *Attorney, Agent, or Firm* — Rader, Fishman & Grauer PLLC

(57) ABSTRACT

A base for a slalom pole or ski pole having brush bristles extending from an acircular axially extending base, preferably having a polygonal or hexagonal configuration, the bristles extending from a circular surface adjoining a circular brush section. The base can also be used as a pole anchor.

11 Claims, 18 Drawing Sheets

U.S. PATENT DOCUMENTS 6,979,163 B2 * 12/2005 Brletich et al. ..... 411/418
7,192,058 B2 3/2007 Fleming
7,249,910 B2 * 7/2007 Eckert et al. ..... 404/10
7,261,564 B2 8/2007 Sutula, Jr.
7,377,551 B2 5/2008 Silverman et al.
7,380,561 B2 6/2008 Nobert et al.
7,581,546 B2 * 9/2009 Dumler ..... 132/218
7,658,583 B2 * 2/2010 Homner ..... 411/510
7,794,175 B2 * 9/2010 Menzel et al. ..... 404/10
7,871,221 B2 * 1/2011 Menzel et al. ..... 404/9
2001/0008659 A1 7/2001 Nelson et al.
2005/0061769 A1 3/2005 Messier
2005/0196570 A1 9/2005 Lindsay
2007/0020064 A1 * 1/2007 Mostazo-Oviedo ..... 411/510
2007/0033759 A1 * 2/2007 Dumler ..... 15/187
2007/0077133 A1 * 4/2007 Wesolowska ..... 411/508
2007/0147975 A1 * 6/2007 Homner ..... 411/510
2008/0111365 A1 5/2008 Kraabel
2008/0116682 A1 5/2008 Best et al.
2008/0163915 A1 7/2008 Wobrock
2008/0196328 A1 8/2008 Ardern
2009/0028640 A1 1/2009 Menzel et al.
2009/0273173 A1 * 11/2009 Jacobs ..... 280/821
2009/0293900 A1 * 12/2009 Holloway et al. ..... 132/218
2010/0290834 A1 * 11/2010 Menzel et al. ..... 404/11

* cited by examiner

POLE ANCHOR AND SKI POLE BASE WITH EXTENDING BRUSH BRISTLES AND ACIRCULAR, PREFERABLY HEXAGONAL, SECTION

CROSS-REFERENCE TO RELATED APPLICATION

This application claims the benefit of provisional patent application Ser. No. 61/071,491, filed May 1, 2008.

FIELD OF THE INVENTION

This invention relates to a base for a ski pole or slalom pole having brush bristles laterally extending from an acircular or non-circular, preferably hexagonal, injection molded base. More particularly, this invention relates to such a base having an acircular cross section with a plurality of brush bristles axially extending along an adjoining circular portion of the base adjacent to the acircular cross section, and radially extending from the base. Still more particularly, this invention relates to such an acircular base having a polygonal cross section having at least three faces and preferably hexagonal cross section transitioning to a circular cross sectional portion of the base having a circular cross section with the brush bristles extending therefrom.

BACKGROUND OF THE INVENTION

Ski poles or slalom poles are known having a handled or tethered shaft terminating in a base for securing the pole in snow while a skier is skiing or maneuvering on a snow-covered course. U.S. Pat. No. 4,221,393 is one example of such a pole made from an injection-molded, lightweight plastic material having a solid generally cylindrical configuration. U.S. Pat. No. 6,390,109 is another example of a pole with a quick-releasing interchangeable lateral support extension in which the pole has an injection-molded base.

Such exemplary poles, when equipped with a base having a circular cross section are susceptible to difficulties in establishing a gripping relationship between the base and the snow. In U.S. Pat. No. 7,192,058, one embodiment uses an injection-molded illuminated disc that functions to provide snow resistance when a skier thrusts the pole into the snow. Other features for the base are known in the art. For example, U.S. Pat. No. 6,015,165 shows a collapsible, transportable attachment for use with ski poles and other equipment to better support and disperse a user's weight in deep snow or to better maintain stability of equipment in deep snow. The '165 patent also shows a base with a foot member attachment having an hexagonal shape for the attachment terminating in a circular shaft.

A ski pole having a plurality of axially extending brush bristles radially extending from a circular shaft of a base for a ski pole is known from a sample of which the inventor of this application is aware. In that sample, the plurality of brush bristles were four or more in number extending for several inches along a circular shaft in which the brushes were injection-molded integrally with the base, apparently providing an improved gripping surface for keeping slalom poles in the snow. However, it was desired to improve the gripping capability for the base when secured to a circular base member because inadvertent base rotation continued to interfere with a tendency of such a base to rotate out of a gripping opening made by insertion of the brush bristles Other examples of ski poles include U.S. Pat. Nos. 6,460,891, 3,858,900, and 4,093,250.

Technology is also available for integrally molding brush bristles into a molded plastic holder, such as brushes shown in U.S. Pat. No. 5,679,067, or commercially available hair brushes. However, it would be beneficial to provide a slalom pole with enhanced gripping characteristics over those provided by integrally molded brushes on circular base members of slalom poles. The present invention provides these benefits and this advantage.

OBJECTS AND SUMMARY OF THE INVENTION

It is an object of the invention to provide a base for a ski pole or slalom pole that is structured to enhance securing a pole base in snow, even if finely powdered. Bristles are expected to be shown as effective in maintaining the base secure in snow.

It is another object of the invention to provide a ski pole or slalom pole base with an acircular base to prevent the base from rotating in the snow and inhibiting a tendency to rotate out of the opening made by the pole base in snow.

It is another object of the invention to provide the acircular base with a polygonal cross section with at least three faces and preferably six faces to form a hexagonal cross section.

Yet another object of the present invention is to provide an injection-molded plastic base for a slalom or ski pole having strength and temperature characteristics consistent with a potential user on a ski slope or other snow-covered surface.

Accordingly, this invention relates to a slalom pole or ski pole, of a type which comprises an injection-molded, axially extending, base having a surface defined by an acircular cross-section; and brush-shaped bristles extending from an adjoining circular surface to the acircular, cross-sectional base for securing the base in snow. A concrete example of such a pole is made from a plastic material integrally molding said bristles in the plastic material, physically resembling a hair brush in concept.

The pole preferably includes a feature that the acircular cross section of the base is polygonal having at least three faces, and more preferably six faces for inhibiting rotation of the base while implanted in snow, thus causing a loss in stability for the user.

The base preferably includes a feature wherein the rows of brush-shaped bristles, preferably three in number, are located along an axial length of a brush surface transitioned from the acircular surface and extend radially from that axial length. Preferably, the plurality of brush bristles are perimetrically located about the brush surface at about equal spaces along the perimeter of the brush surface. Usually, three or more brushes are contemplated, but a greater or lesser number could also be used.

In use, the base is secured to a shaft optionally having a tethered distal end to be secured by a hand of a user. The shaft may also include a portion that is made up from a plurality of alternating wafer-like sections giving flexibility and breakaway strength to the pole.

The anterior end of the base terminates in a generally onion-shaped member having a circular cross section along varying diameters, terminating in a point. Preferably, the angle of a diminishing portion of the tip at the extreme anterior end is 45 degrees.

The base of the invention further includes a collar member at about a joinder position between a shaft and said base. In one embodiment, the collar member is cylindrical. In another embodiment, as shown, the collar member has a leaf shape like a three or four-leaf clover with a thickness for placement at a joinder between the shaft and the base. The collar member may be integral with or a separate attachment from the base member. The collar member delineates snow depth and provides an insertion step.

Another use of the base is for a pole anchor. As the pole anchor, the base includes an elongated shaft and a plurality of tufts of bristles. The elongated shaft extends along and centrally about a vertically-extending longitudinal axis. The shaft has a pole-receiving section, a pointed section and a bristle-attachment section. The bristle-attachment section is disposed between and connected to the pole-receiving section and the pointed section. The pole-receiving section has a pole-receiving hole extending longitudinally therethough and six flat pole-receiving side walls. The six flat pole-receiving side walls are connected to each other to form a hexagonal configuration. Also, the six flat pole-receiving side walls have respective outer surfaces that are textured, i.e. roughened. Further, the bristle-attachment section has the six flat bristle-attachment side walls connected to each other to form a hexagonal configuration. Also, the bristle-attachment side walls have a plurality of bristle-receiving holes that are formed into each one of the six flat bristle-attachment side walls. The pointed section has an inwardly-tapering frusto-conical distal end portion that extends away from the bristle-attachment section.

These objects and other advantages of the present invention will be better appreciated in view of the detailed description of the exemplary embodiments of the present invention with reference to the accompanying drawings, in which:

These drawings of the main features of the slalom or ski pole base according to the invention are exemplary and admit to variations in these essential features of the invention according to circumstances of use.

DETAILED DESCRIPTION OF THE EXEMPLARY EMBODIMENTS

The present invention, may, however, be embodied in various different forms and should not be construed as limited to the exemplary embodiments set forth herein; rather, these exemplary embodiments are provided so that this disclosure will be thorough and complete and will fully convey the scope of the present invention to those skilled in the art.

Figure 1:
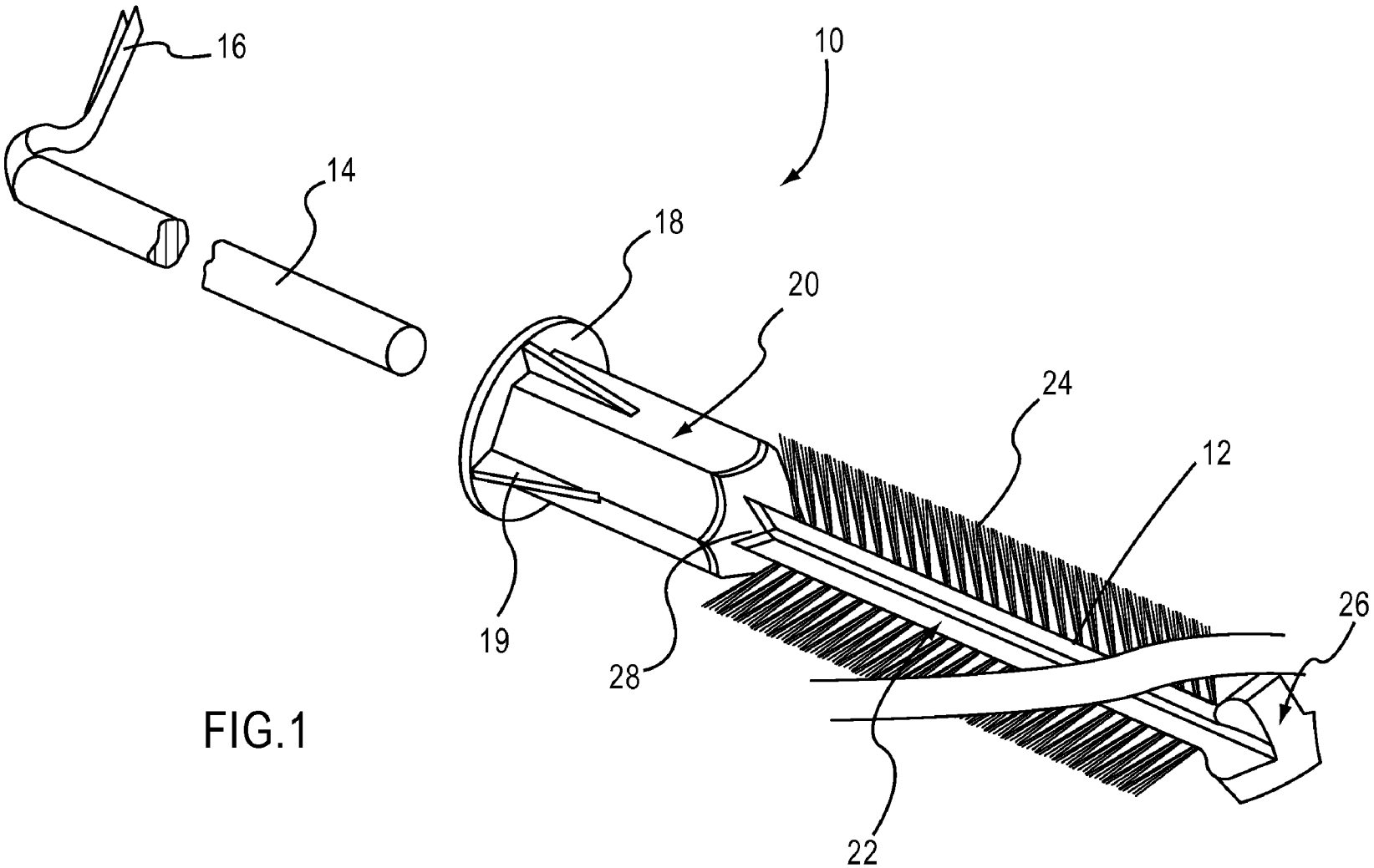
FIG. 1 is a perspective view of a base member according to the invention for connection to a ski or slalom pole having an optionally tethered end.

FIG. 1 is a perspective view of a base member according to the invention, shown generally by the reference numeral 10, for being secured at its distal end to a ski pole shaft or slalom pole shaft 14 having, for example, a tethered end 16, or a handle for being held while in use by a skier. In this embodiment, a circular collar 18 is proved at about the joinder area for inserting the pole shaft 14 in a bore in the member 20 best seen in FIG. 4. The collar 18 is, in this embodiment, strengthened by a plurality of support members 19 axially extending from the collar 18 and secured to an acircular member 20. The shaft may be a conventional solid shaft, or an articulated shaft connected to provide flexibility. By the construction, the base invention may be part an original shaft/base combination, or the base may be used to retrofit an existing ski pole shaft or an existing slalom pole shaft.

The acircular member 20 is shown in this embodiment in its preferred hexagonal shape, thus having six faces about its perimeter. However, the acircular member might also be of a polygonal shape having at least three faces about its perimeter. The acircular member 20 transitions at a location 28 to a circular shaft member 22 having an axial length. A plurality of brush bristles 24 are provided about the periphery of the circular member and are secured by injection molding the brush bristles onto the shaft. Preferably, the base member 10, including the acircular member 20 and the circular shaft 22, are made from a suitable plastic material having a strength characteristic suitable for its intended use by a user on a ski slope or other snow-covered surface.

Figure 2:
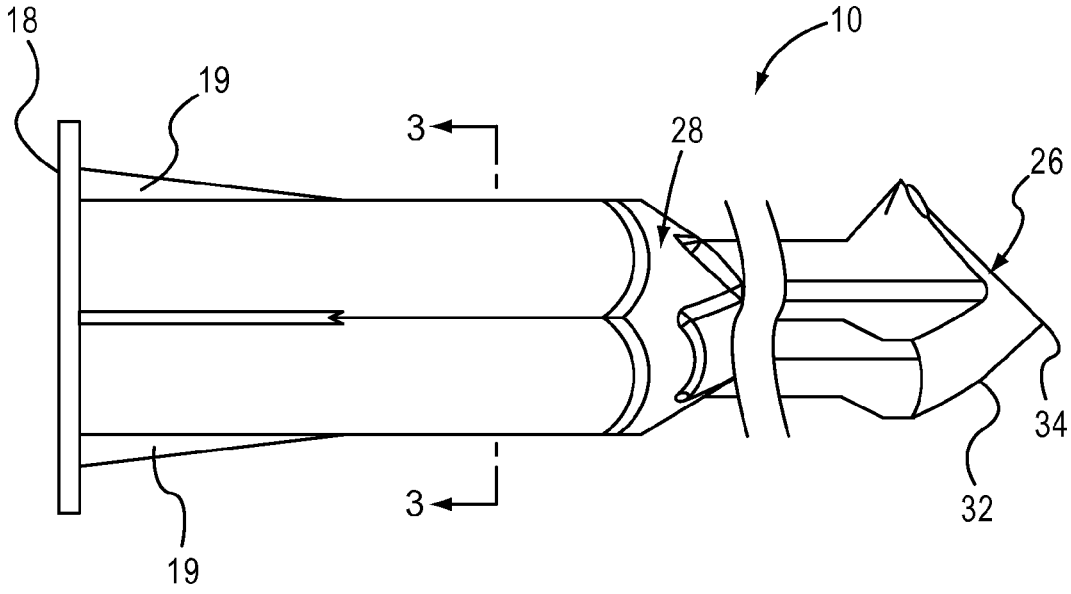
FIG. 2 is a side plan elevational view shown substantially in an interrupted layout of the base according to the invention.

The circular shaft 22 transitions to a sloped tip member 32 having a generally onion-shaped configuration, best seen in FIG. 2 located at the anterior end of the base member 10. Preferably, the tip member 32 is continuously formed by injection molding, and terminates in a tip 34. The angle of the sloping walls 26 of the tip member 32 is preferably 45 degrees.

The plurality of rows of brush bristles are axially located along a suitable axial distance of the circular member and, for example, are three in number usually equally spaced about the perimeter of the shaft 22. The number of rows of bristles may vary. The brush bristles extend radially outward from the circular shaft to protrude a slight distance from an outer flat of the member 20 to aid in improving a gripping capability of the base member 10. This structure has an advantage in that the gripping capability of the brushes secured to the circular member 22 tend to rotate out of a gripping opening my by insertion of the brush bristles when the member 20 is also cylindrical having a circular cross section. That tendency is overcome, at least to a surprising degree, by providing the acircular member 20 having a plurality of faces.

Figure 3:
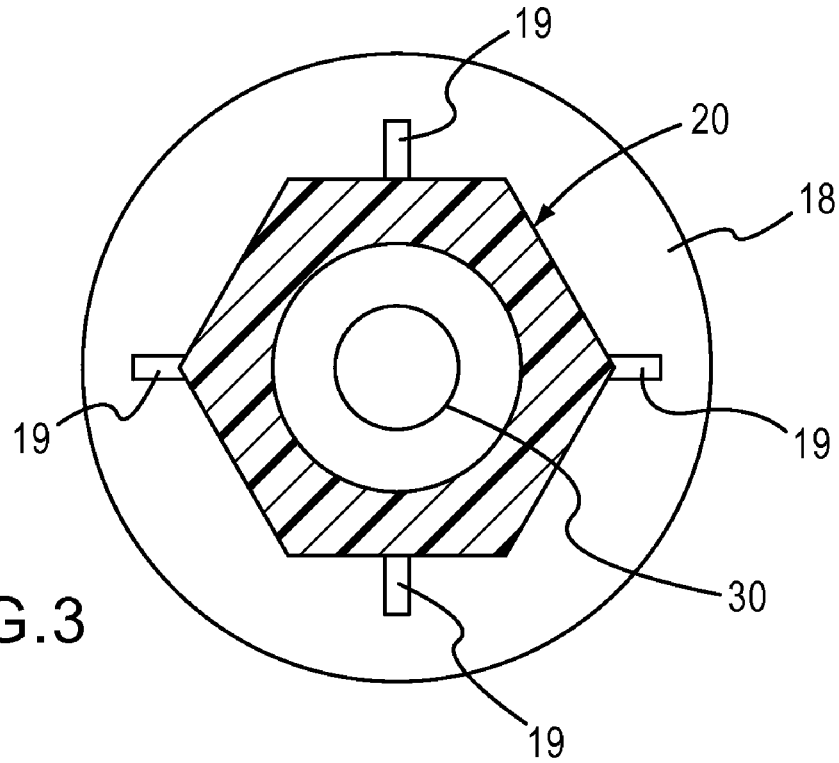
FIG. 3 is cross sectional view taken along line 3-3 of FIG. 2.
Figure 4:
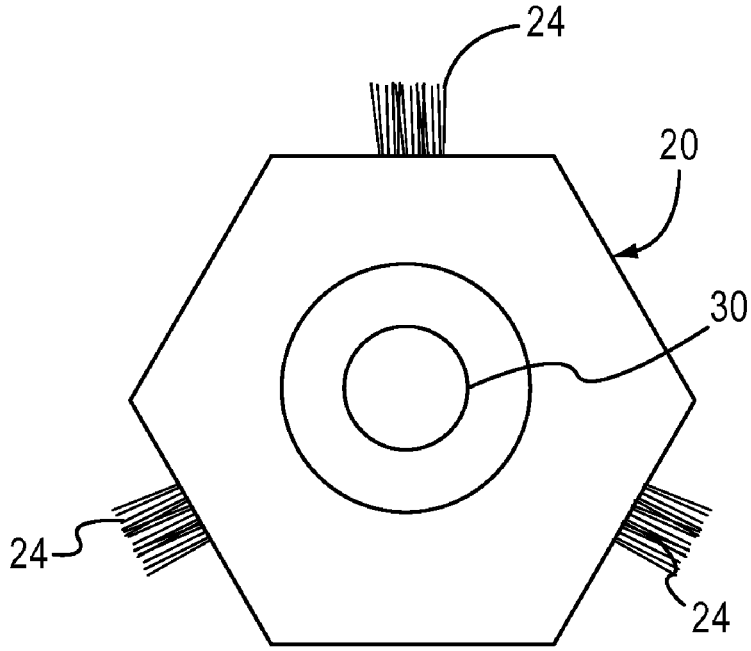
FIG. 4 is an end view of the base member showing an end where a shaft joins the base member according to the invention.

A concrete example of dimensions for the base member are expected to be about 12.50 inches from the collar 18 to the tip 34. The collar is expected to be about 2.50 inches in diameter while the bore 30, best seen in FIG. 4, is expected to transition from about 1.0 inches to about to about 0.50 inches. A length of the support member 19 typically is expected to be about 1.60 inches, and the distance across the flats of the hexagonal member 20 is about 1.50 inches. These dimensions are representative of the embodiment shown in FIG. 2 which is a side plan elevational view shown in an interrupted layout of the base member 10 according to the invention. A cross section taken along line 3-3 in shown in FIG. 3.

FIG. 4 is an end view of the member 20 showing the bore 30 for receiving a diameter of an end of the pole shaft 14. FIG. 4 also depicts the extent to which the brush bristles extend beyond the flats of the hexagonal surface 20.

FIGS. 5 to 10 show prototypes of the implementation of the invention described for the base member 10, in various positions and levels of magnification for exposition of features of the invention. Reference numerals in common with the numerals used in FIGS. 1 to 4 are consistent.

Figure 5:
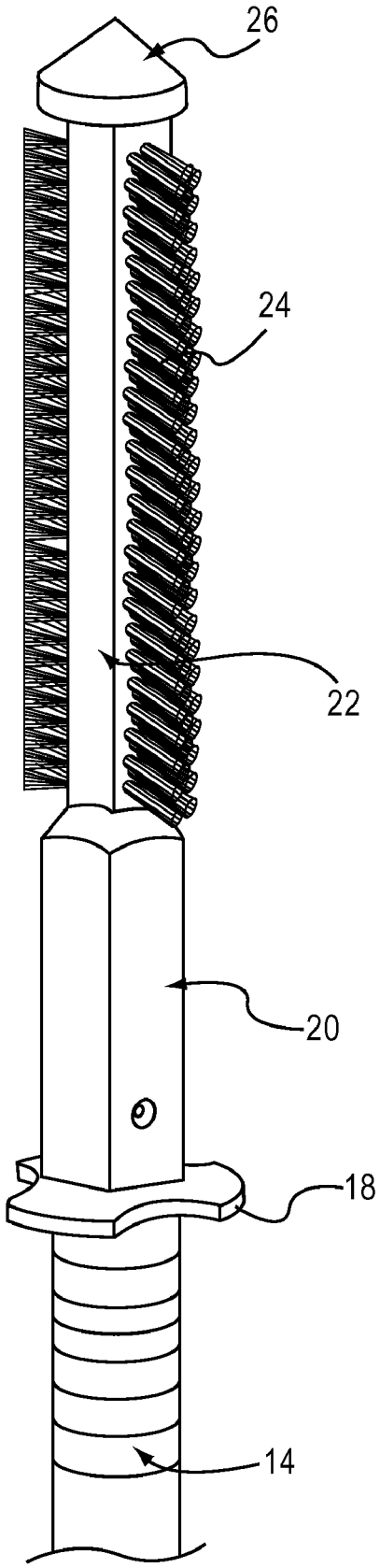
FIG. 5 is plan pictorial view of the base according to the invention, showing the hexagonal shaft, a plurality of brush bristles, a tip, a collar and a shaft similar to a significant portion of FIG. 1, but having a differently-shaped collar.
Figure 6A:
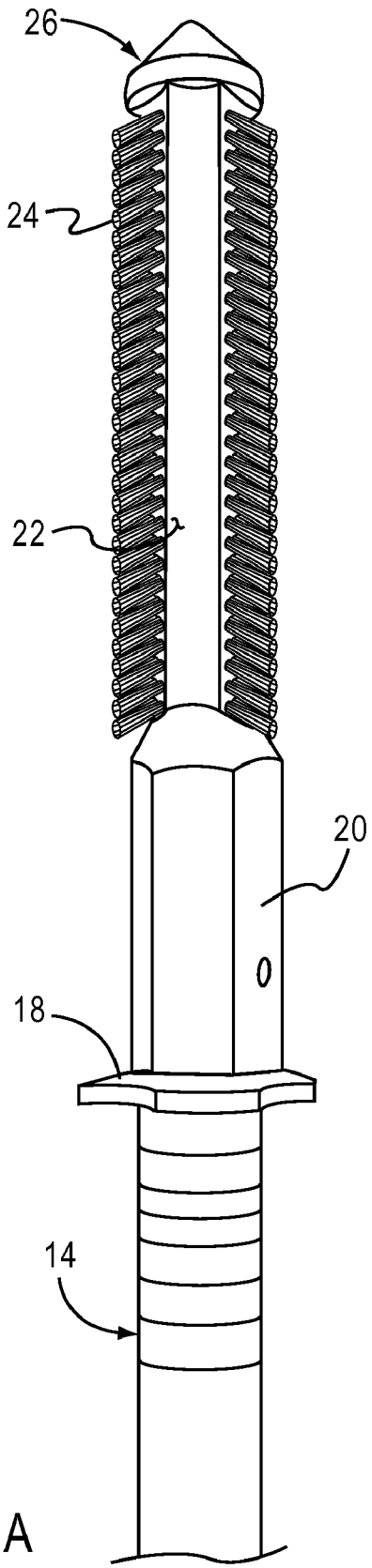
FIGS. 6A and 6B show views of the combination along the lines of FIG. 5 but respectively rotated to show the brush bristles from different facets of the hexagonal shaft.
Figure 6B:
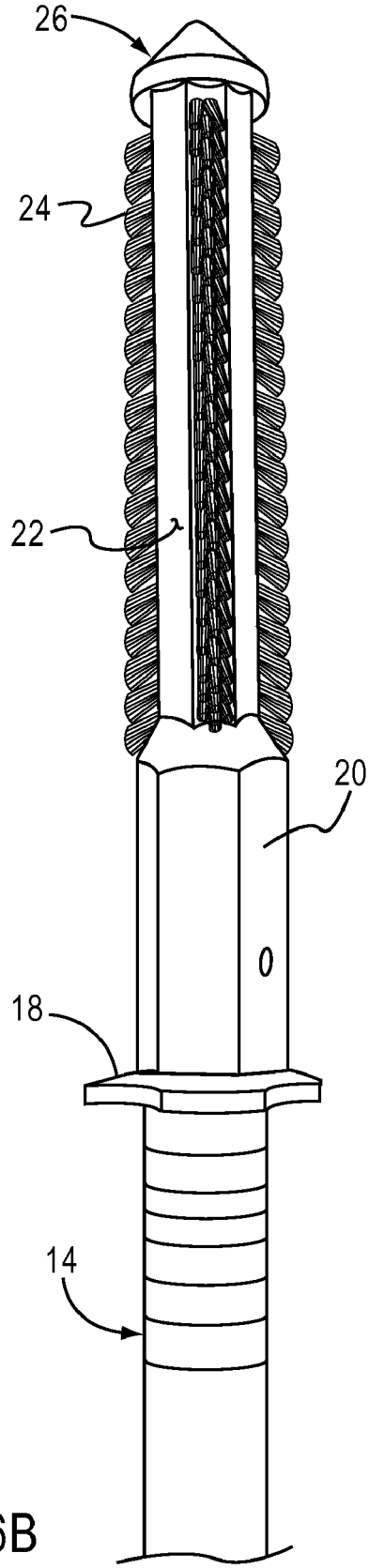
Figure 7:
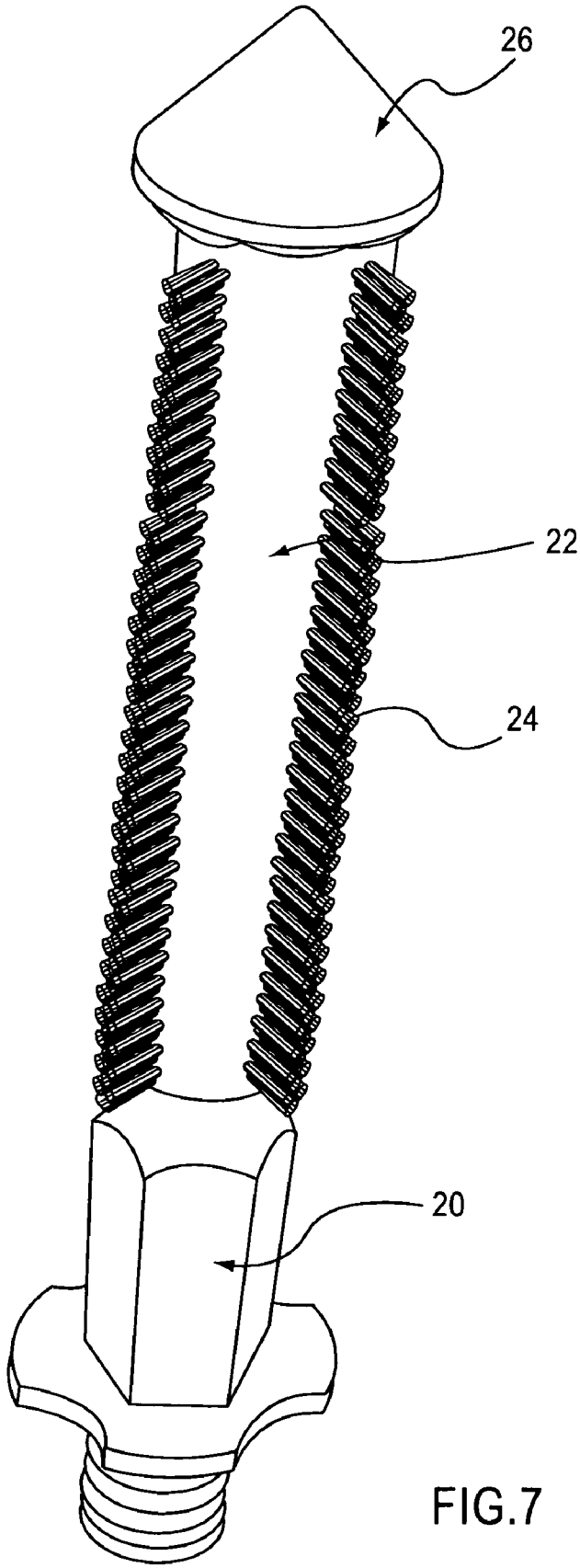
FIG. 7 is a plan perspective view of the anterior end of the base member according to the invention along the lines of FIGS. 6A and 6B and further showing the brush bristles at a greater close up.
Figure 8:
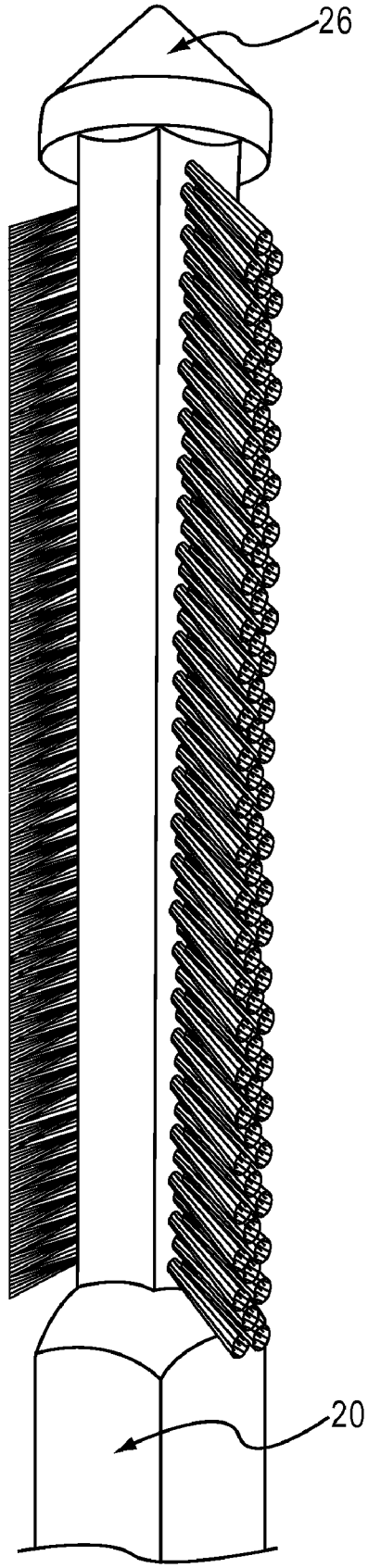
FIG. 8 is another perspective view of the anterior end of the base member as in FIG. 7, but at a greater magnification.
Figure 9:
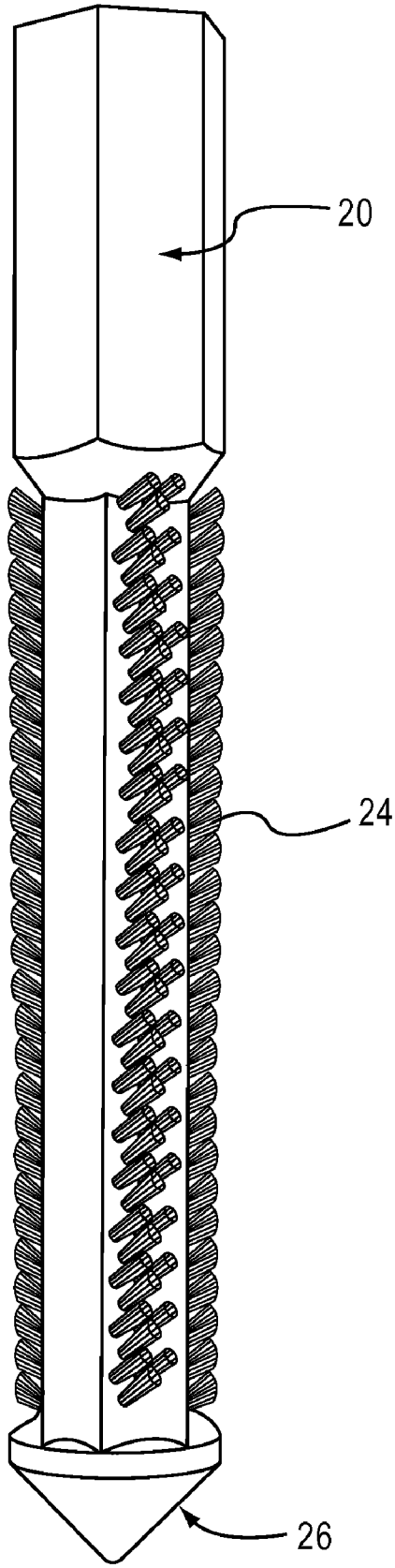
FIG. 9 is an alternative embodiment of the anterior end of the base with a different joinder structure.

The depiction in FIG. 7 is noteworthy in that the collar 38 is shaped somewhat like a four-leafed clover and is located at the location of the collar 18. FIGS. 5 and 6 show this alternative collar arrangement.

Figure 10:
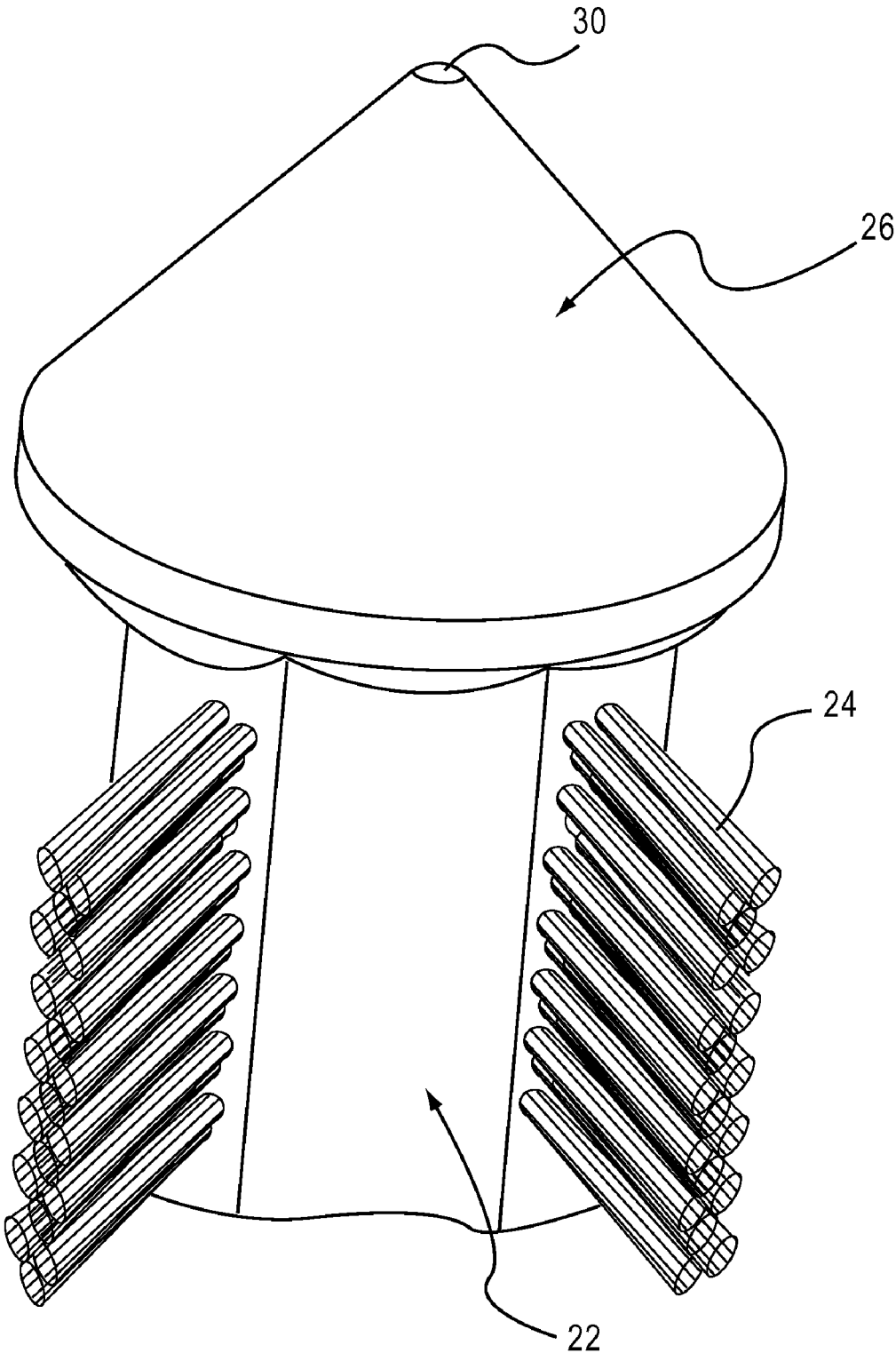
FIG. 10 is a more highly magnified view of the anterior tip of the base member according to the invention.
Figure 11:
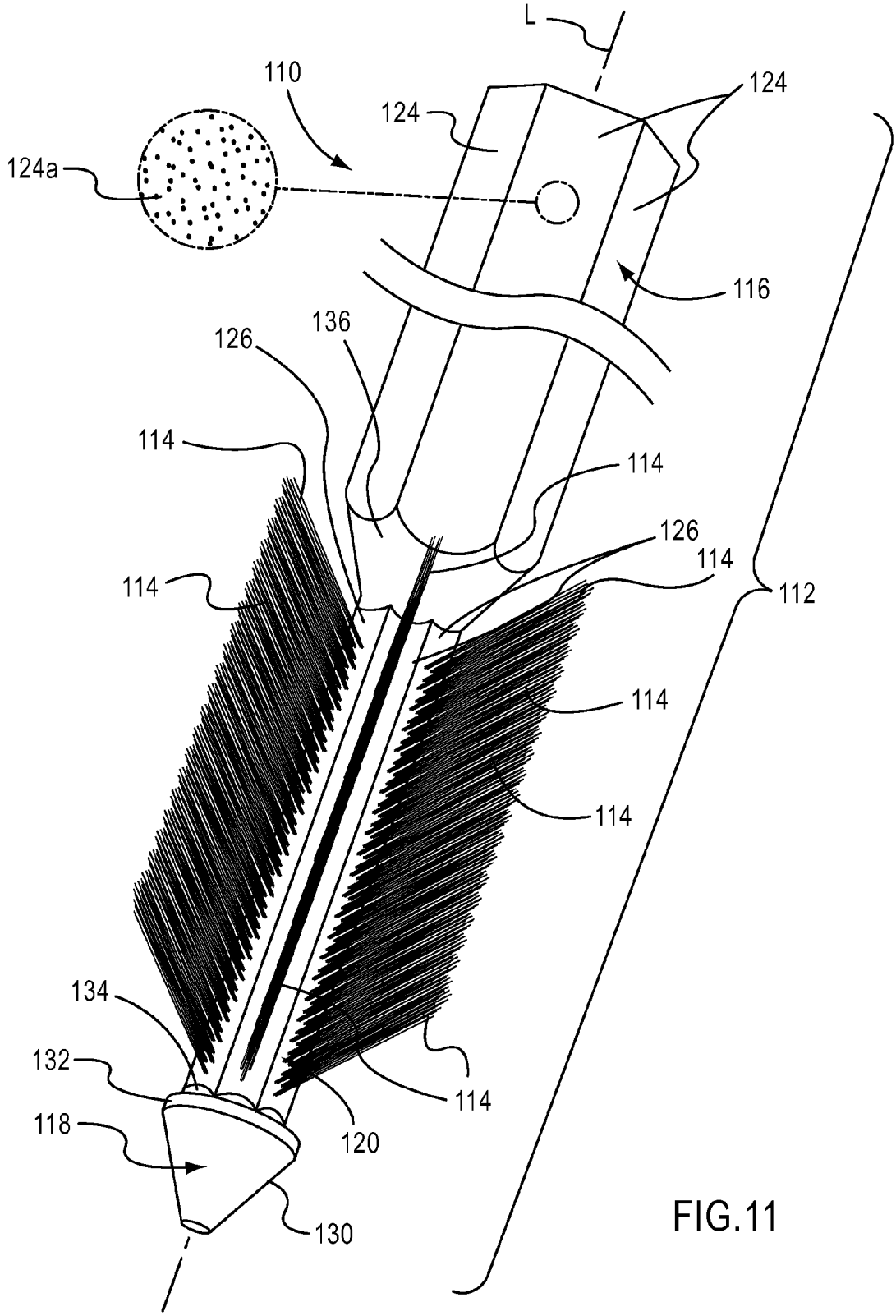
FIG. 11 is a perspective view of second exemplary embodiment of a pole anchor of the present invention.
Figure 12:
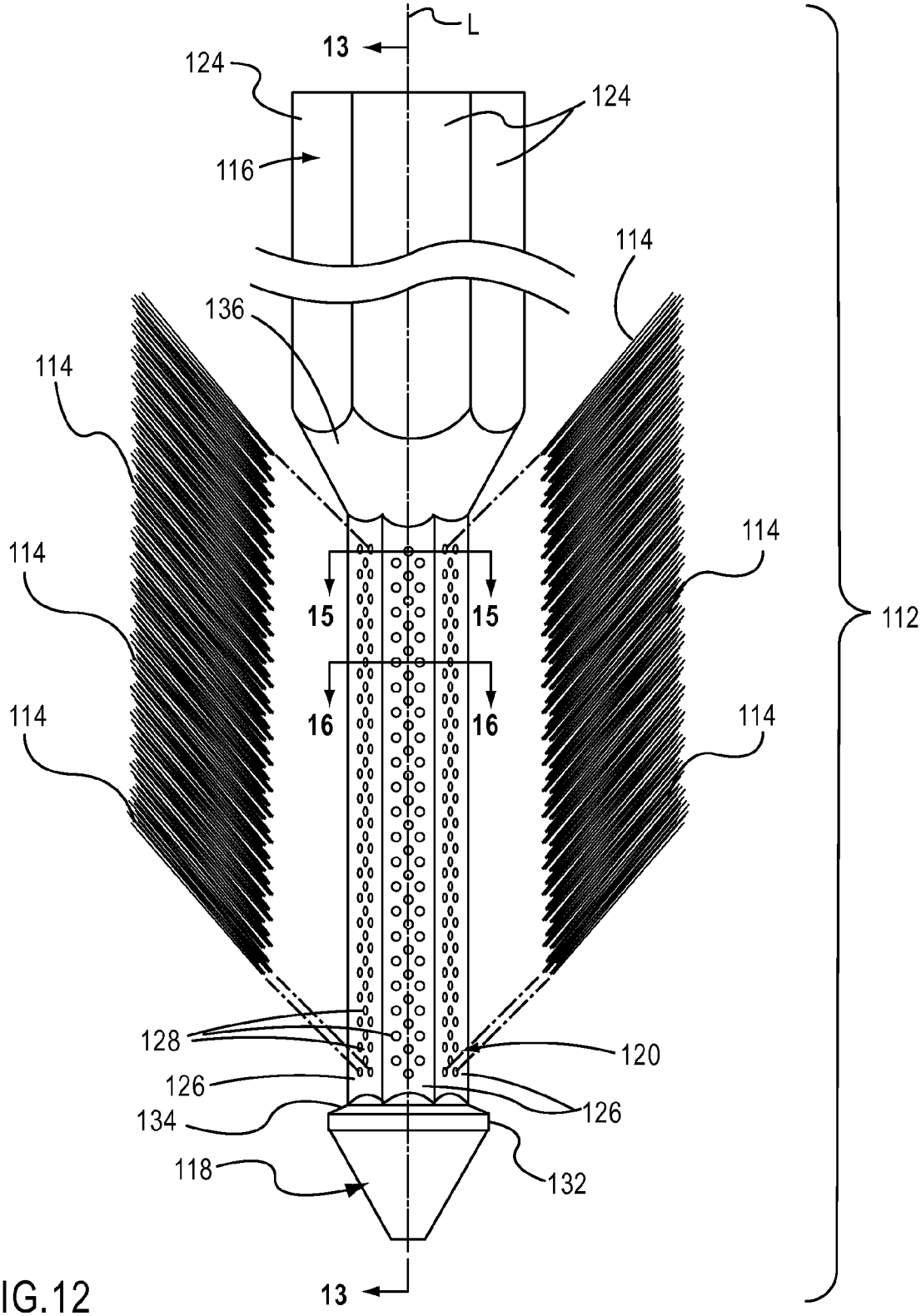
FIG. 12 is a front elevation view of the pole anchor of the present invention shown in FIG. 11 (with the center tufts of bristles removed for clarity purposes only).
Figure 13:
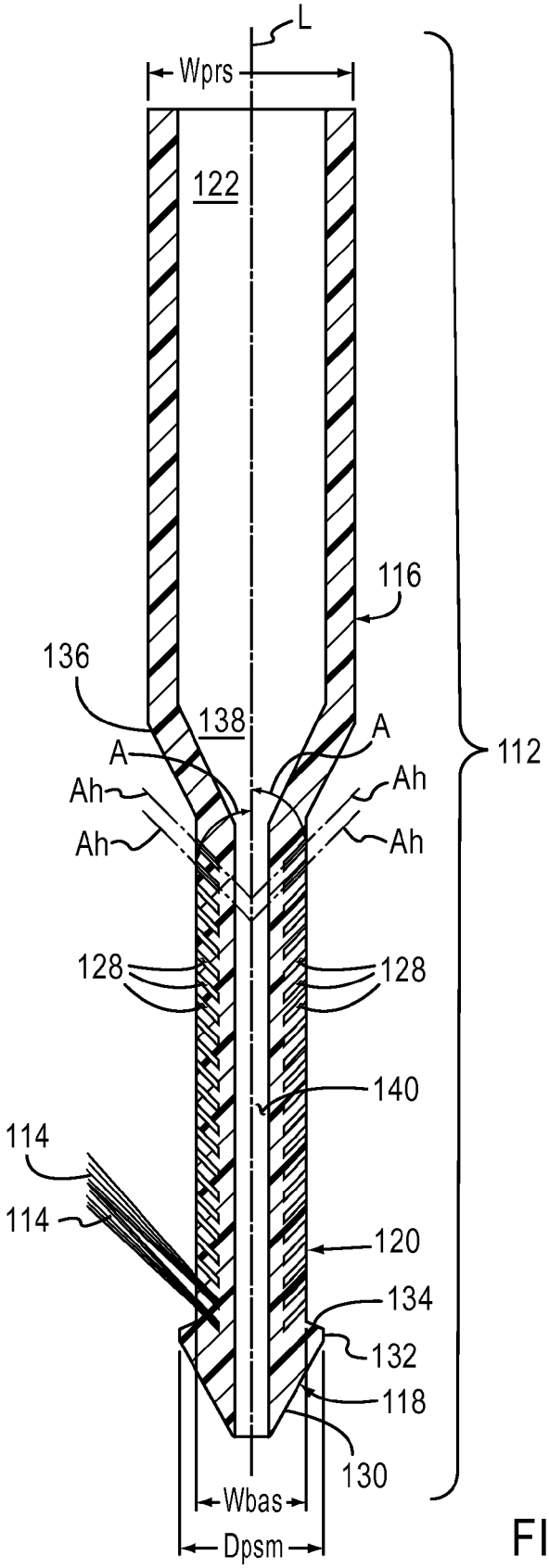
FIG. 13 is a front elevation view shown in cross section of the pole anchor taken along line 13-13 in FIG. 12.
Figure 14:
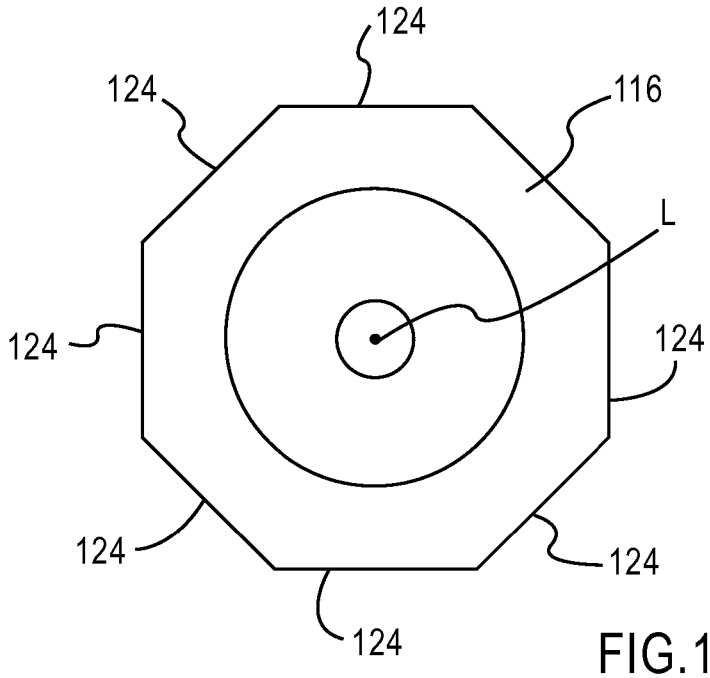
FIG. 14 is a top plan view of the pole anchor of the present invention illustrated in FIGS. 11-13.
Figure 15:
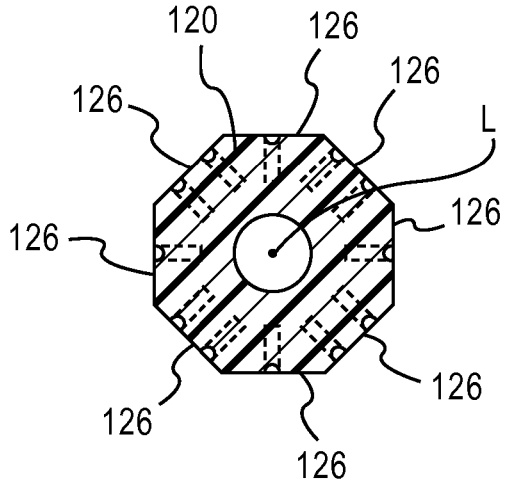
FIG. 15 is a cross-sectional view of the pole anchor of the present invention taken along line 15-15 in FIG. 12.
Figure 16:
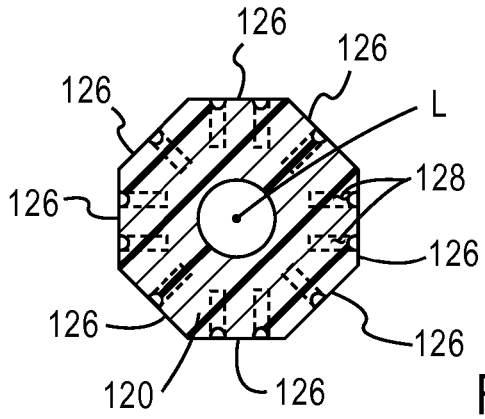
FIG. 16 is a cross-sectional view of the pole anchor of the present invention taken along line 16-16 in FIG. 12.

Another use of the base 10 is introduced in FIGS. 11-18D. The base 10 is employed as a pole anchor 110 as hereinafter described. Particularly with reference to FIGS. 11-13, the base 10 includes an elongated shaft 112 and a plurality of tufts of bristles 114. The elongated shaft 112 extends along and centrally about a vertically-extending longitudinal axis L. The shaft 112 has a pole-receiving section 116, a pointed section 118 and a bristle-attachment section 120. The bristle-attachment section 120 is disposed between and connected to the pole-receiving section 116 and the pointed section 118. The pole-receiving section 116 has a circular pole-receiving hole 122 (FIG. 13) extending longitudinally therethough and six flat pole-receiving side walls 124 (FIGS. 11, 12 and 14). The six flat pole-receiving side walls 124 are connected to each other to form a hexagonal configuration as viewed in plan view in FIG. 14. Also, the six flat pole-receiving side walls 124 have respective outer surfaces 124*a* that are textured as shown in the enlarged portion of FIG. 11 to inhibit slippage of the pole anchor 110 from a hand of a user or of a tool such as a crescent wrench or box wrench gripping the pole-receiving section 16. Further, the bristle-attachment section 120 has six flat bristle-attachment side walls 126 that are connected to each other to form a hexagonal configuration as viewed in cross section in FIGS. 15 and 16. Also, the bristle-attachment side walls 126 have a plurality of bristle-receiving holes 128 that are formed into each one of the six flat bristle-attachment side walls 126. In FIGS. 10-12, the pointed section 118 has an inwardly-tapering frusto-conical distal end portion 130 that extends away from the bristle-attachment section 120.

As best shown in FIG. 13, each tuft of bristles 114 is received in a respective one of the plurality of bristle-receiving holes 128 in a tight-fitting manner. One of ordinary skill in the art would appreciate that each tuft of bristles 114 are force-fitted into respective ones of the bristle-receiving holes 128 although other means, such as by an adhesive, could also be used to secure the tufts of bristles 114 in the bristle-receiving holes 128. Furthermore, a skilled artisan would comprehend that, in FIG. 12, the center plurality of tufts of bristles is removed from the drawing figure for clarity of illustration only.

With reference to FIG. 13, the pole-receiving section 116 has a pole-receiving section width Wprs, the bristle-attachment section 120 has a bristle-attachment section width Wbas and the pointed section has a pointed section maximum diameter Dpsm. Note that the pole-receiving section width Wprs is larger than the pointed section maximum diameter Dpsm and the pointed section maximum diameter Dpsm is larger than the bristle-attachment section width Wbas.

As best shown in FIG. 13, each one of the plurality of bristle-receiving holes 128 extends into respective ones of the bristle-attachment side walls 126 along a hole axis Ah that forms an acute angle A that extends towards the pole-receiving section 116 and generally relative to the longitudinal axis L.

Figure 17A:
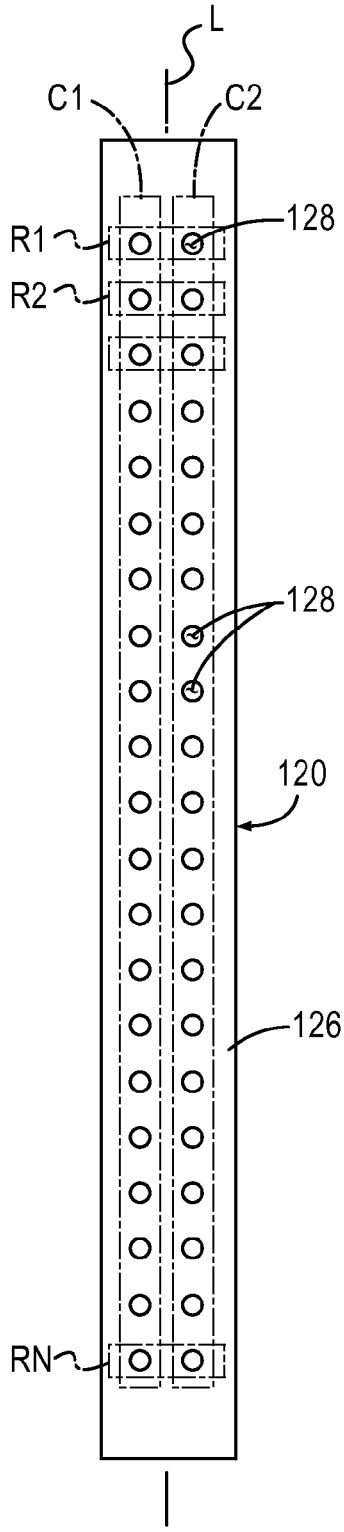
FIGS. 17A-17C are diagrammatical views of exemplary hole patterns formed by bristle-receiving holes formed in a pole-receiving section of the pole anchor of the present invention.
Figure 17B:
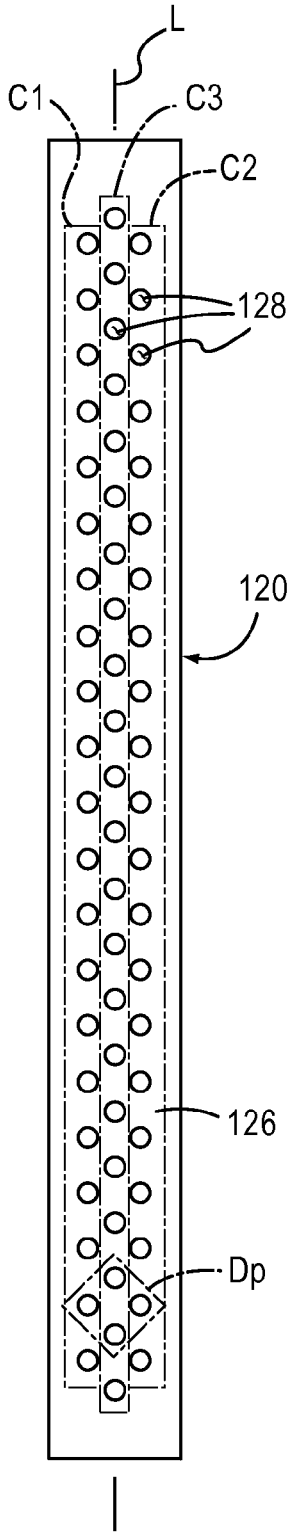
Figure 17C:
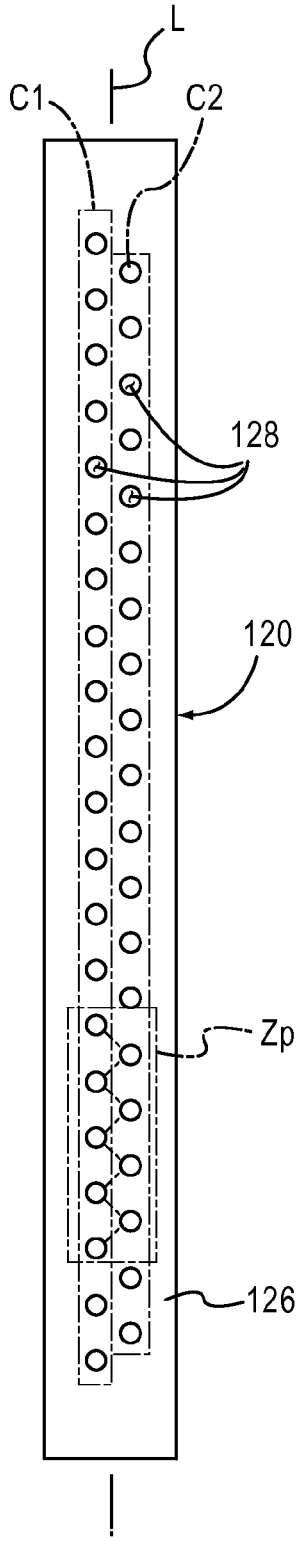

A skilled artisan would appreciate that the bristle-receiving holes 128 can form any one or a combination of hole patterns which are illustrated by way of example only and not by way of limitation in FIGS. 17A-17C illustrated as diagrammatic views. In FIG. 17A, the plurality of bristle-receiving holes 128 for each one of the six flat bristle-attachment side walls 126 includes a first column C1 of bristle-receiving holes 128 that extends longitudinally along and parallel with the longitudinal axis L and a second column C2 of bristle-receiving holes 128 that is disposed adjacent and parallel to the first column C1 of bristle-receiving holes 128. In FIG. 17A, the first column C1 of bristle-receiving holes 128 and the second column C2 of bristle-receiving holes 128 form a plurality of parallel rows R1-Rn of bristle-receiving holes 128.

In FIG. 17B, the plurality of bristle-receiving holes 128 for each one of the six flat bristle-attachment side walls 126 includes a third column C3 of bristle-receiving holes 128 that extends longitudinally and parallel to the first and second columns C1 and C2 of the bristle-receiving holes 128 respectively. Note that the third column C3 is disposed between columns C1 and C2 and the third column C3 is vertically offset from columns C1 and C2 thereby forming a generally vertically-extending diamond pattern Dp of bristle-receiving holes 128. However, one of ordinary skill in the art will appreciate that one of the first, second and third columns C1-C3 is disposed between a remaining two of the columns with the one column disposed between the remaining two columns being vertically offset from the remaining two columns to form the generally vertically-extending diamond pattern Dp of bristle-receiving holes 128.

In FIG. 17C, the first column C1 of bristle-receiving holes 128 and the second column C2 of bristle-receiving holes 128 are vertically offset from one another thereby forming vertically-extending zig-zag pattern Zp.

Again, with reference to FIGS. 11-13, the pointed section 118 includes a disk portion 132 and a frusto-conical bristle-attachment connection portion 134. The disk portion 132 is integrally connected between the inwardly-tapering frusto-conical distal end portion 130 and the frusto-conical bristle-attachment connection portion 134. The frusto-conical bristle-attachment connection portion 134 tapers inwardly from the disk portion 132 towards the bristle-attachment section 120 and terminates as an integral connection with the bristle-attachment section 120.

Furthermore, the shaft 112 includes a frusto-conical pole-receiving connection portion 136 that is disposed between and is integrally connected to the pole-receiving section 116 and the bristle-attachment section 120. The frusto-conical pole-receiving connection portion 136 tapers inwardly from the pole-receiving section 116 towards the bristle-attachment section 120 and terminates at the bristle-attachment section 120. The frusto-conical pole-receiving connection portion 136 defines a frusto-conically-shaped pole-receiving connection portion hole 138 interiorly of the shaft 112 as illustrated in FIG. 13. Again, with reference to FIG. 13, a combination of the bristle-attachment section 120 and the pointed section 118 define a shaft hole 140 that extends longitudinally therethrough. With this arrangement, the frusto-conically-shaped pole-receiving connection portion hole 138 is disposed between and interconnects the circular pole-receiving hole 122 and the shaft hole 140. Additionally, the frusto-conically-shaped pole-receiving connection portion hole 138 tapers inwardly from the circular pole-receiving hole 122 and terminates at the shaft hole 140 thereby forming a continuous hole, i.e, the circular pole-receiving hole 122, the frusto-conically-shaped pole-receiving connection portion hole 138 and the shaft hole 140, through the shaft 112 that has three specific but communicating hole sections as discussed above.

Figure 18A:
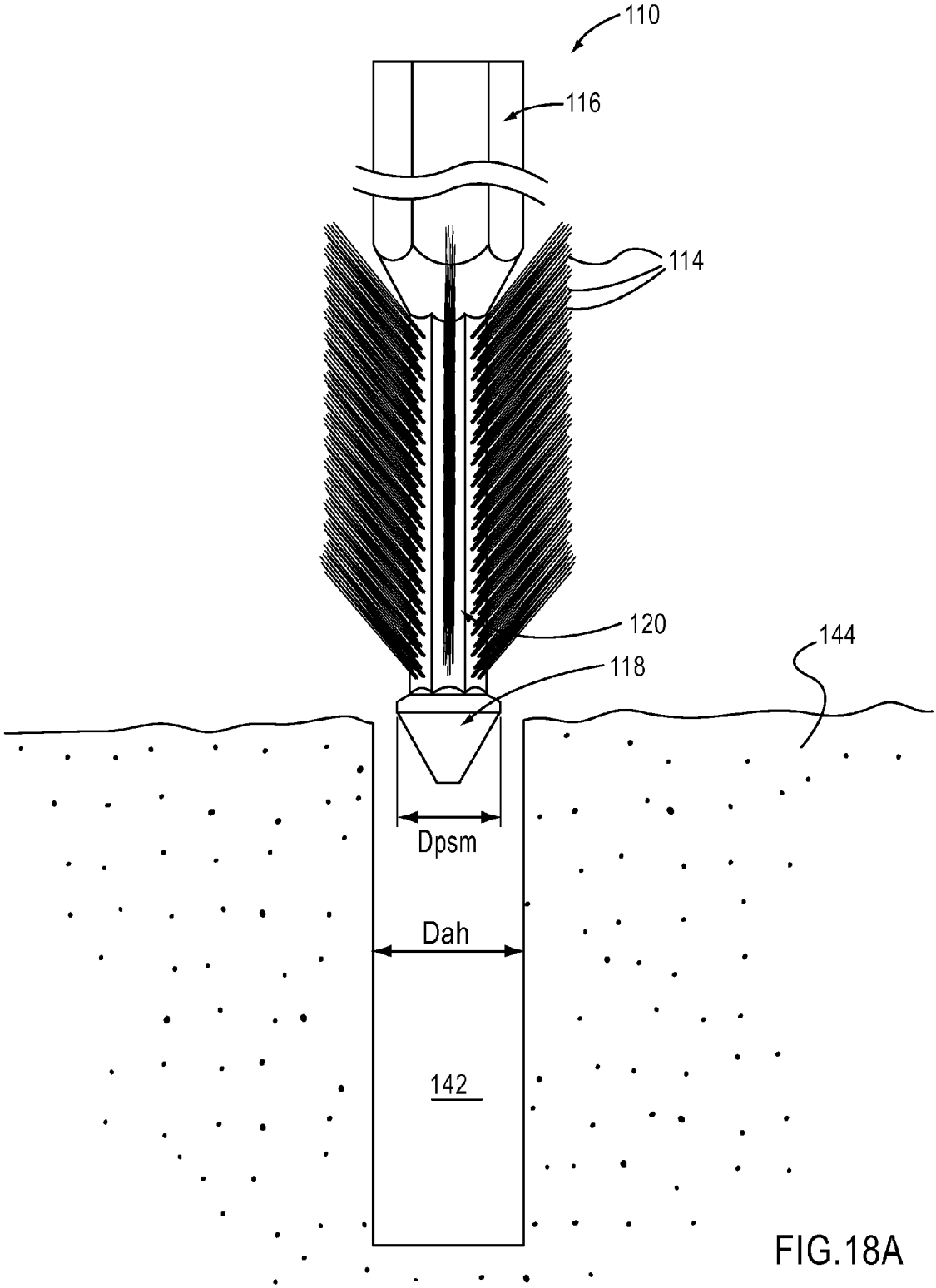
FIGS. 18A-18D are diagrammatical views of the pole anchor of the present invention being inserted into an anchor hole of a mounting base such as a snow pack or packed soil.
Figure 18B:
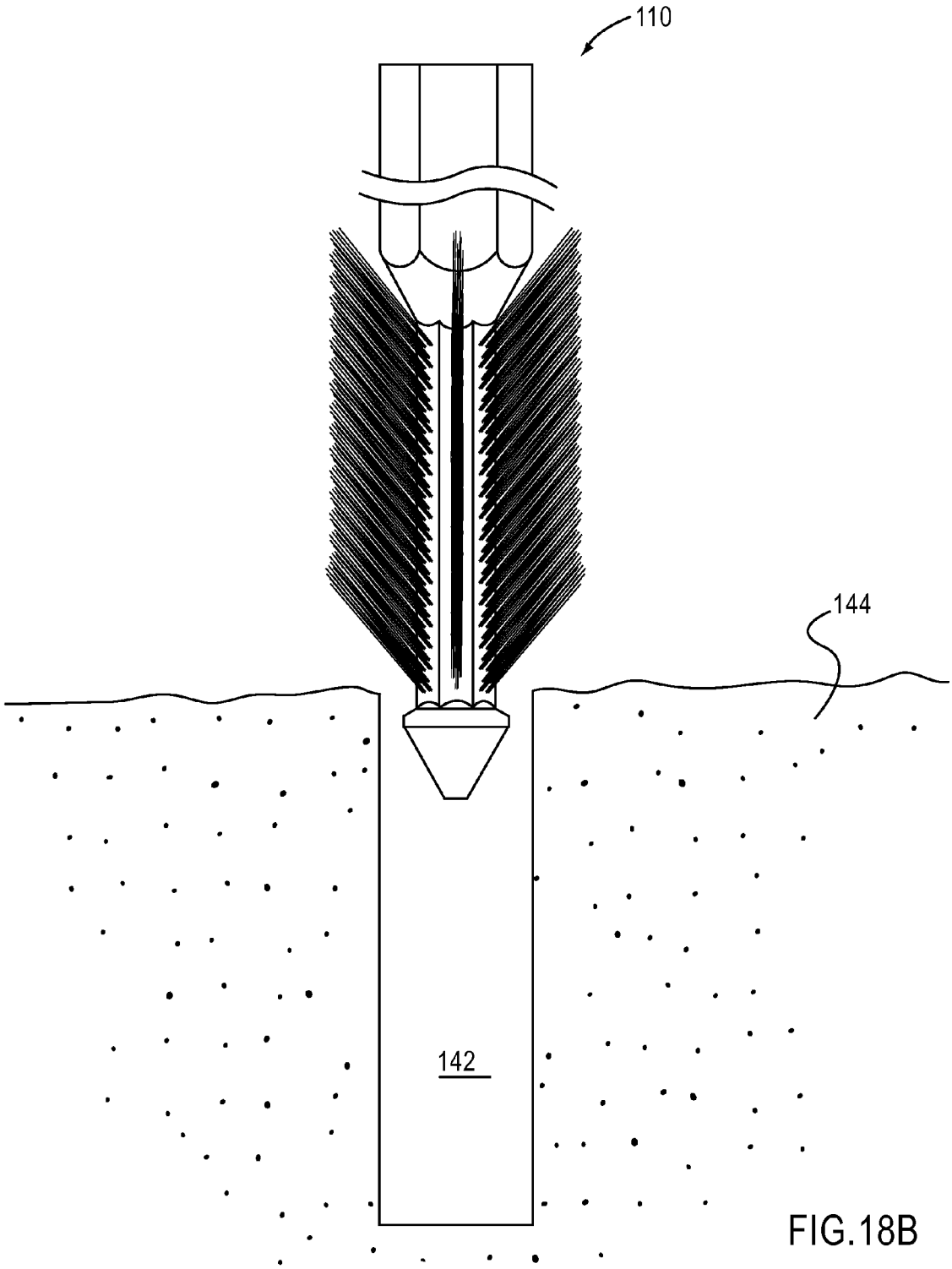
Figure 18C:
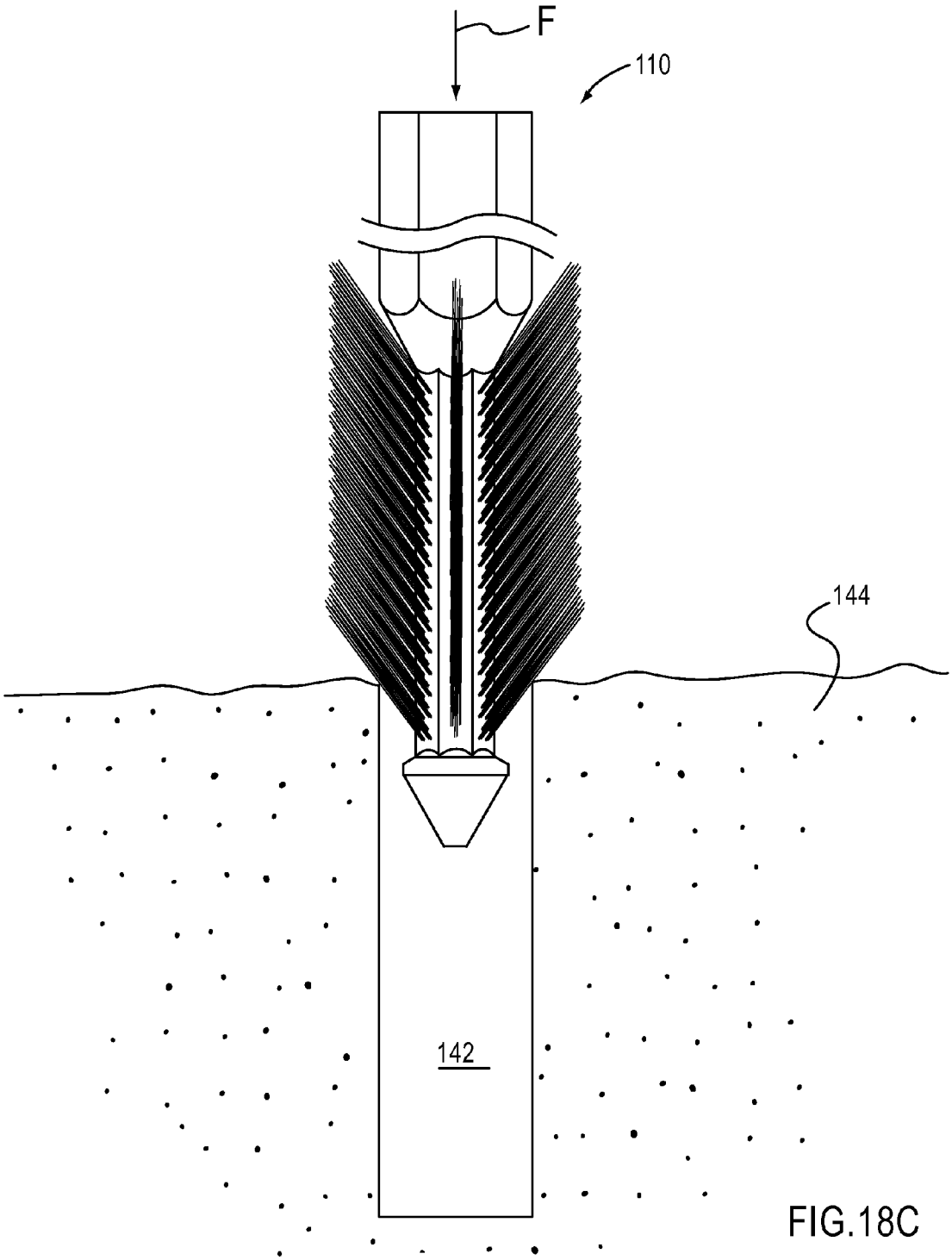
Figure 18D:
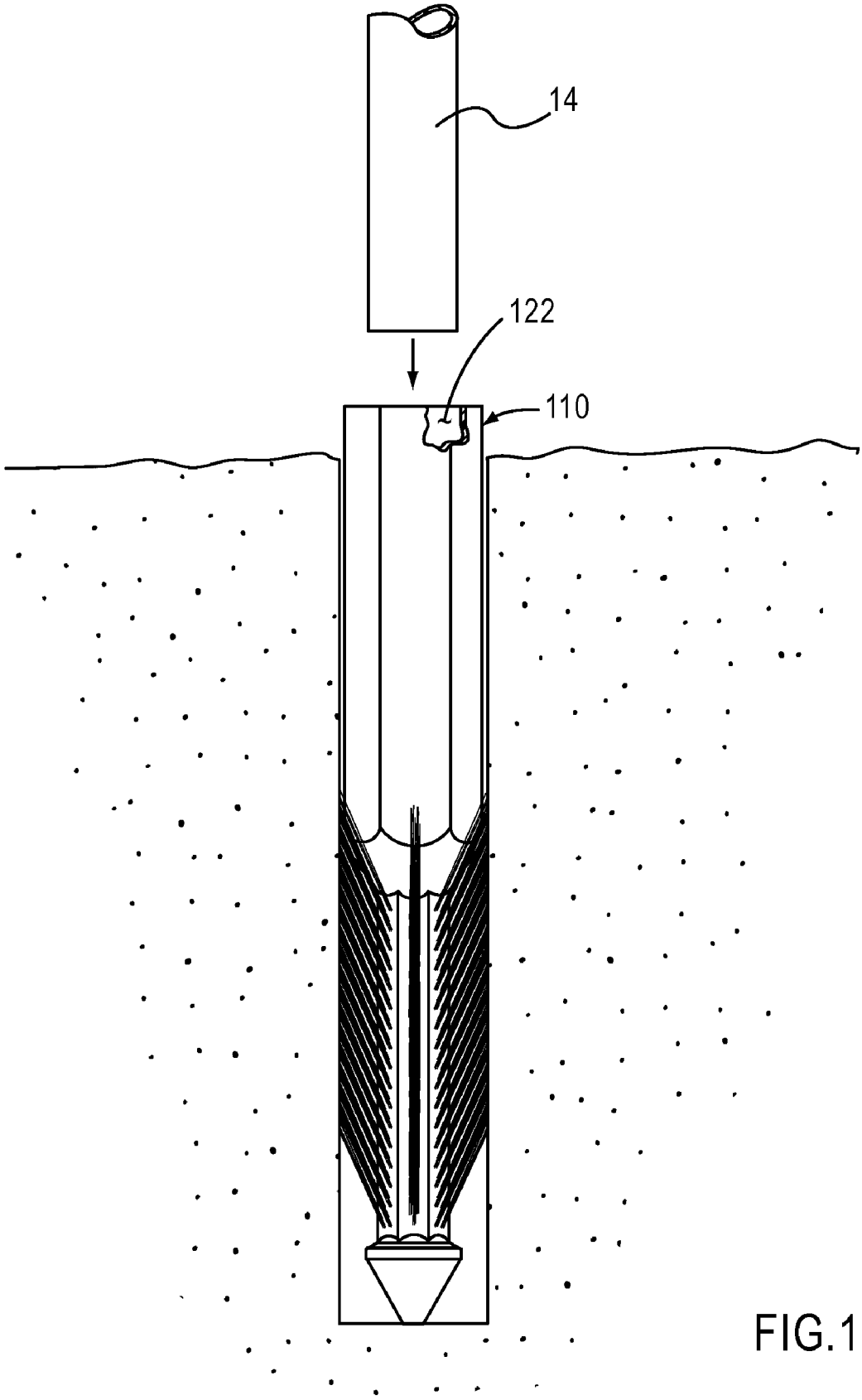

In FIGS. 18A-18D, the pole anchor 110 is inserted into an anchor hole 142 formed into any suitable mounting base 144 such as a snow pack or packed soil or even plastic, wood or metal. Preferably, the anchor hole 142 has an anchor hole diameter Dah that is slightly larger than the pointed section maximum diameter Dpsm. In FIGS. 18A and 18B, the pointed section 118 is first inserted into the anchor hole 142. As the pole anchor 110 is received in the anchor hole 142, leading ones of the plurality of tufts of bristles 114 contact the mounting base 144 defining the opening into the anchor hole 142 as shown in FIG. 18C. With a downwardly-directed force F (arrow F), the leading ones of the plurality of tufts of bristles 114 as well as the remaining ones of the plurality of tufts of bristles 114 bend as contact is made with the mounting base 144 inside the anchor hole 142 as shown in FIGS. 18C and 18D. Once the pole anchor 110 is received in the anchor hole 142 as shown in FIG. 18D, the pole 14 can be inserted into the circular pole-receiving hole 122 in the pole-receiving section 116 of the pole anchor 110.

These embodiments and their obvious variations meet the objects and features explained in the Summary of the Invention and described in the pending claims.

What is claimed is:

1. A slalom pole or ski pole, comprising:

an injection-molded, axially extending, base having a surface defined by an non-circular cross-section; and brush-shaped bristles extending from an adjoining circular surface adjacent to said non-circular, cross-sectional base for securing said base in snow, wherein said non-circular cross-section is hexagonal defining six facets, said hexagonal cross-section providing an inhibition to said base from rotating in the snow.

2. A pole anchor, comprising:

an elongated shaft extending along and centrally about a vertically-extending longitudinal axis, the elongated shaft having a pole-receiving section, a pointed section and a bristle-attachment section disposed between and connected to the pole-receiving section and the pointed section, the pole-receiving section having a pole-receiving hole extending longitudinally therethrough and six flat pole-receiving side walls connected to each other to form a hexagonal configuration as viewed in plan view, the bristle-attachment section having six flat bristle-attachment side walls connected to each other to form a hexagonal configuration as viewed in cross section and a plurality of bristle-receiving holes formed into each one of the six flat bristle-attachment side walls, the pointed section having an inwardly-tapering frusto-conical distal end portion extending away from the bristle-attachment section; and a plurality of tufts of bristles, each of the plurality of the tufts of bristles received in a respective one of the plurality of bristle-receiving holes in a tight-fitting manner, wherein the pole-receiving section has a pole-receiving section width, the bristle-attachment section has a bristle-attachment section width and the pointed section has a pointed section maximum diameter with the pole-receiving section width being larger than the pointed section maximum diameter and the pointed section maximum diameter being larger than the bristle-attachment section width.

3. A pole anchor as set forth in claim 2, wherein each one of the plurality of bristle-receiving holes extends into the bristle-attachment side walls along a hole axis that forms an acute angle extending towards the pole-receiving section.

4. A pole anchor as set forth in claim 2, wherein the plurality of bristle-receiving holes for each one of the six flat bristle-attachment side walls includes a first column of bristle-receiving holes extending longitudinally therealong and a second column of bristle-receiving holes disposed adjacent and parallel to the first column of bristle-receiving holes.

5. A pole anchor as set forth in claim 4, wherein the first column of bristle-receiving holes and the second column of bristle-receiving holes are vertically offset from one another to form a vertically-extending zig-zag pattern.

6. A pole anchor as set forth in claim 4, wherein the first column of bristle-receiving holes and the second column of bristle-receiving holes form a plurality of parallel rows of bristle-receiving holes.

7. A pole anchor as set forth in claim 4, wherein the plurality of bristle-receiving holes for each one of the six flat bristle-attachment side walls includes a third column of bristle-receiving holes extending longitudinally and parallel to the first and second columns of bristle-receiving holes, one of the first, second and third columns being disposed between a remaining two of the columns with the one column being vertically offset from the remaining two columns forming a generally vertically-extending diamond pattern of bristle-receiving holes.

8. A pole anchor as set forth in claim 2, wherein the pointed section includes a disk portion and a frusto-conical bristle-attachment connection portion with the disk portion being integrally connected between the inwardly-tapering frusto-conical distal end portion and the frusto-conical bristle-attachment connection portion, the frusto-conical bristle-attachment connection portion tapering inwardly from the disk portion towards the bristle-attachment section and terminating in integral connection with the bristle-attachment section.

9. A pole anchor as set forth in claim 2, wherein the elongated shaft includes a frusto-conical pole-receiving connection portion disposed between and integrally connecting the pole-receiving section and the bristle-attachment section, the frusto-conical pole-receiving connection portion tapering inwardly from the pole-receiving section towards the bristle-attachment section and terminating at the bristle-attachment section.

10. A pole anchor as set forth in claim 9, wherein the frusto-conical pole-receiving connection portion defines a frusto-conically-shaped pole-receiving connection portion hole interiorly of the elongated shaft and a combination of the bristle-attachment section and the pointed section define a shaft hole extending therethrough such that the frusto-conically-shaped pole-receiving connection portion hole is disposed between and interconnects the pole-receiving hole and the shaft hole, the frusto-conically-shaped pole-receiving connection portion hole tapering inwardly from the pole-receiving hole and terminating at the shaft hole.

11. A pole anchor as set forth in claim 9, wherein each one of the six flat pole-receiving side walls has an outer textured surface.

* * * * *